United States Patent [19]

Rutkowski et al.

[11] 4,324,082

[45] Apr. 13, 1982

[54] METAL STUD

[75] Inventors: Edward J. Rutkowski, Kenmore; Carl R. Mapes, Clarence; Steven D. Wing, Getzville; Jack A. Dawdy, Kenmore, all of N.Y.

[73] Assignee: National Gypsum Company, Dallas, Tex.

[21] Appl. No.: 92,587

[22] Filed: Nov. 8, 1979

[51] Int. Cl.[3] ..... E04C 3/07

[52] U.S. Cl. ..... 52/481; 52/738; 52/781

[58] Field of Search ..... 52/481, 495, 738, 482, 52/349, 355, 163, 353, 281, 282, 781, 303; 220/75; 113/116 Y

[56] References Cited

U.S. PATENT DOCUMENTS

| | | | |
|---|---|---|---|
| 1,307,814 | 6/1919 | Fletcher | 52/355 |
| 1,502,112 | 7/1924 | Moorman | 220/75 |
| 1,563,651 | 12/1925 | Pomerantz | 52/353 |
| 2,663,390 | 12/1953 | Dordel | 52/482 |
| 3,217,460 | 11/1965 | Downing | 52/781 |
| 3,225,726 | 12/1965 | Tennison | 113/116 Y |
| 4,047,355 | 9/1977 | Knorr | 52/481 |

FOREIGN PATENT DOCUMENTS

| | | | |
|---|---|---|---|
| 1059285 | 7/1979 | Canada | 52/282 |

*Primary Examiner*—James L. Ridgill, Jr.
*Attorney, Agent, or Firm*—Robert F. Hause

[57] ABSTRACT

A metal stud, intended for use where the flanges on one side will be left exposed, having such exposed side flanges formed with an overlapped sheet metal portion, including an under flange and an over flange which are spaced apart to allow a cooling air flow therebetween, wherein the under flange includes means for providing a cooling flow of air or gases at the interface of the under flange and an adjacent gypsum board, which may be a rib in the under flange or a plurality of spaced apart holes in the under flange.

10 Claims, 6 Drawing Figures

METAL STUD

This invention relates to an improved metal stud having a double thickness flange having novel means for remaining relatively cool when the opposite side of the wall, embodying the stud, is exposed to a fire.

U.S. Pat. No. 4,047,355 discloses the combination of a hole through the overlapping flange of the overlapped portion of the stud flange, to allow cooling air to enter the space between the overlapped flanges, creating a chimney effect to move the cooling air.

The present invention is directed to modifying and improving upon this basic idea, to effectively create a second zone of cooling effects, providing cooling at the interface between the inner layer of a double thickness flange and the boards disposed adjacent thereto.

The invention consists essentially of a metal stud having an overlapped flange portion with a gap for air flow therebetween, holes at spaced positions along the under flange, near the outer edge and an elongate rib along the under flange, for stiffening purposes and for spacing board away from the holes.

It is an object of the invention to provide an improved metal stud for resisting heat transmission in case of fire.

It is a further object of the invention to provide a metal stud having effectively two chimney effect cooling gaps, with provision for most effectively circulating cooling air and the cooling steam driven off from the heated gypsum boards.

These and other objects and advantages will be more readily apparent when considered in relation to the preferred embodiments of the invention as set forth in the specification and shown in the drawings in which.

Figure 1:
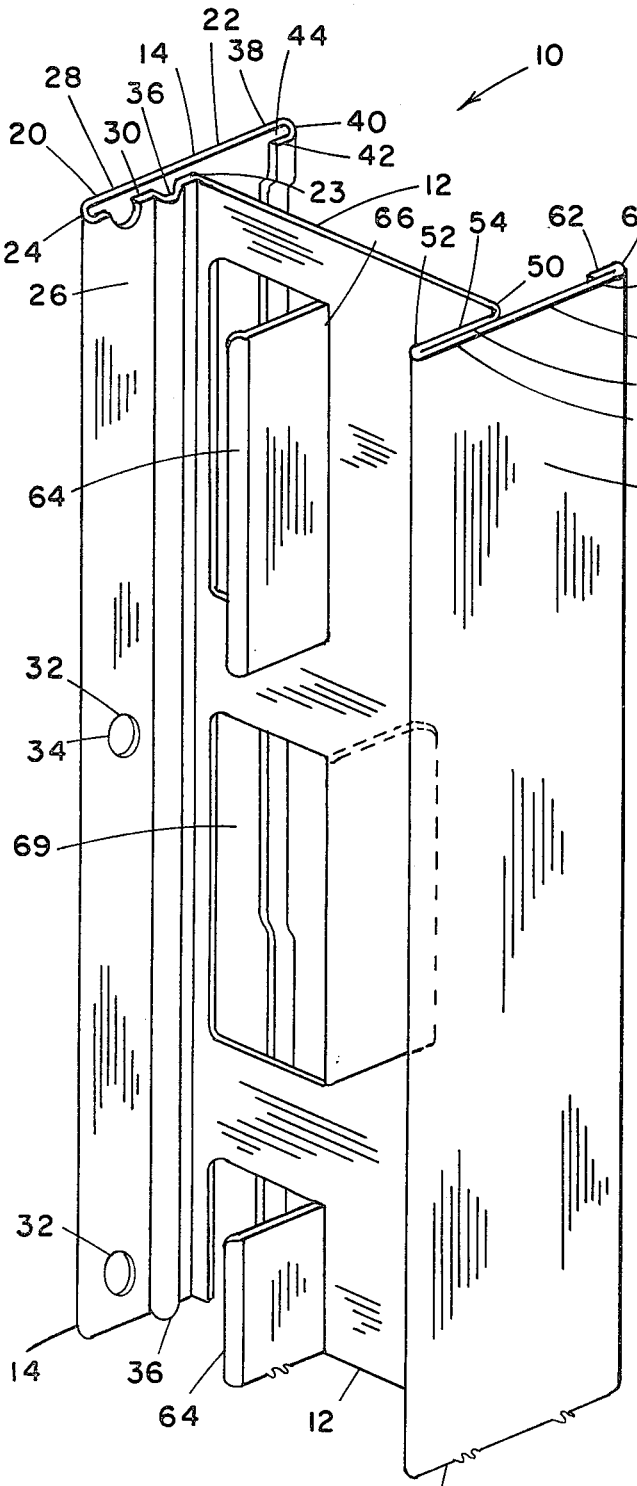
FIG. 1 is an isometric view of a section of stud embodying the present invention.

Referring to FIG. 1, there is shown an elongate lightweight metal stud 10, formed from sheet metal, preferably 24 gauge galvanized steel, and formed as a one-piece unit, including a central web 12 which extends from a first side 14 of stud 10 to a second side 16.

First side 14 has a double thickness flange 20 and a single thickness flange 22. Double thickness flange 20 is formed from sheet metal which extends perpendicularly from the edge 23 of web 12 outwardly to a reverse fold 24 forming inner layer 26 of flange 20. The sheet metal extends from reverse fold 24 back to adjacent the edge 23 of web 12, forming outer layer 28 of flange 20. Outer layer 28 is disposed parallel to inner layer 26 with an internal gap 30 therebetween of about 0.025 inch (0.06 cm) or within a range of about 1/16 to 1/64 inch (0.04 to 0.16 cm).

Inner layer 26 has a plurality of holes 32, each located with an outermost edge 34 located either near to or at reverse fold 24, at spaced positions of about four inches (10 cm) apart, and of a diameter of about $\frac{3}{8}$ inch (1 cm) in a flange 20 width of about $\frac{3}{4}$ inch (2 cm). Inner layer 26 also has an elongate rib 36, disposed between the holes 32 and edge 23 of web 12. Rib 36 projects away from the internal gap 30, and forms a parallel gap 37, to be discussed below relative to FIG. 2.

Single thickness flange 22 extends from outer layer 28 in the opposite direction from web edge 23 and has a width of about $\frac{3}{4}$ inch (2 cm). At the remote edge 38 of single thickness flange 22 there is a reverse fold 40 and a short lip 42 extending back toward web edge 23. In the preferred form, a second internal gap 44 equal to internal gap 30 is provided between lip 42 and flange 22, at spaced portions. Preferably, gap 44 is formed in one inch (3 cm) unpinched sections 43 with two inch (5 cm) tightly pinched section 45 therebetween.

Second side 16 had a double thickness flange 46 and a single thickness flange 48. Double thickness flange 46 is formed from sheet metal which extends perpendicularly from the edge 50 of web 12 outwardly to a reverse fold 52 forming inner layer 54 of flange 46. The sheet metal extends from reverse fold 52 back to adjacent the edge 50 of web 12, forming outer layer 56 of flange 46. Outer layer 56 is disposed parallel to and tight against inner layer 54.

Single thickness flange 48 extends from outer layer 56 in the opposite direction from web edge 50. Flanges 46 and 48 are each about $\frac{3}{4}$ inch (2 cm) wide. At the remote edge 58 of single thickness flange 48 there is a reverse fold 60 and a short lip 62 extending back toward web edge 50.

Web 12 has a plurality of small tabs 64 which are cut and folded out of the metal sheet from which web 12 is made. Tabs 64 are folded along folds 66 which extend parallel to flanges 46 and 48. Some of the tabs 64 are bent about 90 degrees out of the plane of web 12 in one direction and some are bent about 90 degrees out of the plane of web 12 in the opposite direction, with preferably every other tab 64 being in the same direction. Thus every other tab 64 is disposed in spaced parallel relation to flange 20, suitable for holding the edge of a one inch (2.5 cm) gypsum board 68 between the tabs 64 and flange 20. The alternate tabs 64 are disposed in spaced parallel relation to flange 22, suitable for holding the edge of another board 68. The forming of the tabs 64 results in forming holes 69 in web 12 which are located between the folds 66 and the stud first side 14.

Figure 2:
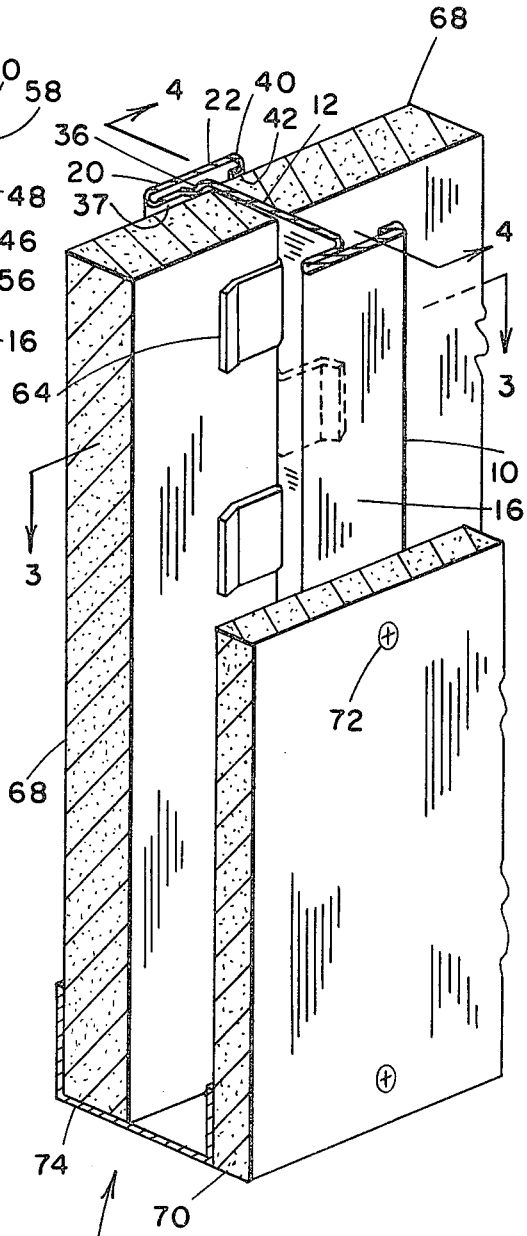
FIG. 2 is an isometric view of a shaft wall embodying the stud of FIG. 1.
Figure 4:
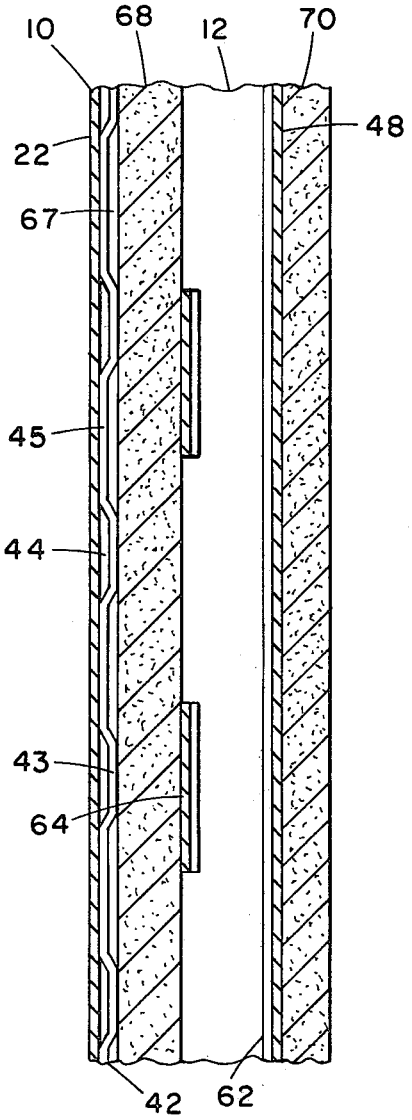
FIG. 4 is a vertical sectional view of the wall of FIG. 2, taken along line 4—4.
Figure 3:
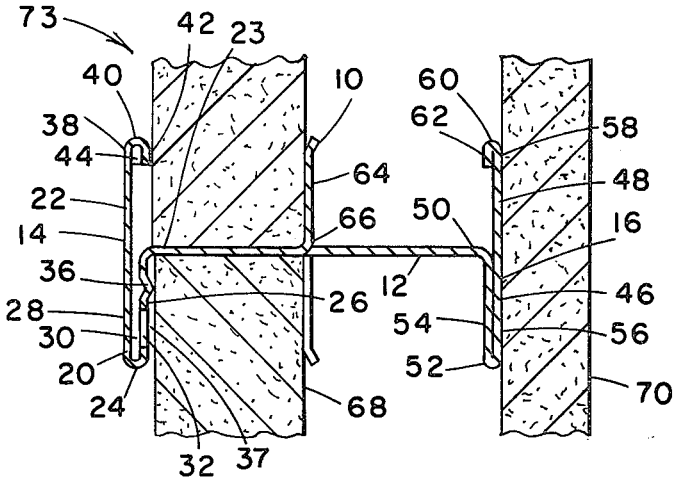
FIG. 3 is a horizontal sectional view of the wall of FIG. 2, taken along line 3—3.

FIGS. 2 to 4 show the boards 68 being held against the inner side of flanges 20 and 22. It will be noted that in both instances the contact of the boards 68 with flanges 20 and 22 is localized along a single narrow area, in the case of flange 20 contact being only along the tip of rib 36, and in the case of flange 22 contact being only along the tip of unpinched sections 43 of short lip 42. Thus gap 37 and a gap 67 between pinched section 45 and board 68 are formed between most of flanges 20 and 22 and the adjacent board 68, 68, preferably with opening dimensions of about 1/16 to 1/64 inch (0.04 to 0.16 cm). Also shown is a gypsum wallboard 70 of about $\frac{5}{8}$ inch ($1\frac{1}{2}$ cm) affixed by screws 72 to the outer face of flanges 46, 48, forming hollow wall 73. One layer of wallboard 70 or multiple layers may be used, dependent on the degree of fire retardancy sought.

The section of wall shown in FIG. 2 also includes a section of floor runner 74.

In a fire test, with the fire on the side adjacent the $\frac{5}{8}$ inch wallboard 70, thermocouples will be placed on the opposite side of the wall in places likely to increase in temperature fastest. A thermocouple on the outer surface of the stud 10, at flange 20 or 22, will not indicate an increase in temperature as fast as in prior studs due to the novel combination of the ribs 36, the resultant gap 37 and the location of holes 32, opening into gap 37. As the stud starts to increase in temperature, air will rise in gaps 30, 37 and 44 and relatively cooler air will be drawn into gaps 30 and 44 through the bottom of the stud or lower holes 32 or gaps 67 and exhausting through holes 32 or gaps 67 higher up. Also it has been found that steam can be seen exiting from holes 32 and gaps 67 higher up, as a result of the heat of the fire driving off water of hydration in the wallboards 68 and 70.

Holes 32, being directed toward gap 37, causes this steam to contact the surfaces surrounding gap 37, preventing these areas from being heated above 212° F. so long as the steam continues to come from holes 32.

Figure 5:
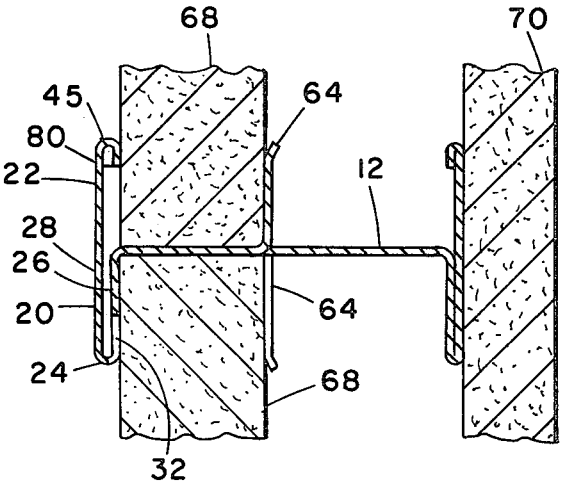
FIG. 5 is a horizontal sectional view of wall having a modified stud in accordance with the invention.

FIG. 5 shows a modified form of the invention, including a stud 80, in which holes 32 are disposed partially in the reverse fold 24, and the inner layer 26 is substantially flat and disposed, generally throughout, against board 68. This modification has performed surprisingly well in a fire test, wherein wetting of the board 68 was very obvious during the test, adjacent the holes 32 along the edge of flange 20 and adjacent the pinched sections 45 along the edge of flange 22, when the opposite side of the wall was exposed to fire.

Figure 6:
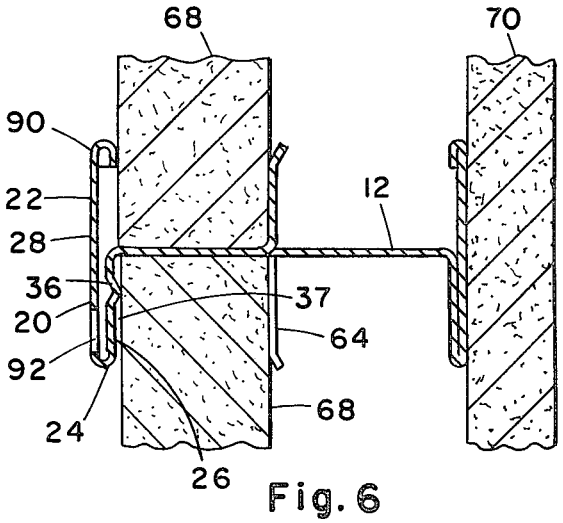
FIG. 6 is a horizontal sectional view of wall having a further modified stud in accordance with the invention.

FIG. 6 shows a further modified form of the invention, including a stud 90, in which holes 92 are disposed in the outer layer 28 of flange 20 and a rib 36, in the inner layer 26, forms a parallel gap 37 between flange 20 and the adjacent board 68, wherein air that becomes heated will tend to rise, drawing in cooler air, to cool the flange 20 and board 68.

Having completed a detailed disclosure of the preferred embodiments of our invention, so that those skilled in the art may practice the same, we contemplate that variations may be made without departing from the essence of the invention.

We claim:

1. A fire-resistant metal stud for supporting a vertical wall comprising an elongate formed sheet metal body having an elongate first side and, opposite thereto, an elongate second side, elongate means central thereof adjoining said first side and said second side, means on said second side for affixing wallboard thereto, a pair of flanges on said first side adapted to have the edges of a pair of wallboards affixed against the inner side thereof, whereby said flanges would be disposed on the surface of a wall formed by said wallboards, said pair of flanges including at least one flange which is formed from an inner layer sheet of metal extending from the inner edge of the flange to the outer edge of the flange whereat the metal is reversely folded and extends back to said inner edge forming an outer layer, said inner layer having means for retarding the increase in temperature of said inner layer and the wallboard surface adjacent thereto when said wall is subjected to a fire on the wall second side, said means for retarding comprising structure which directs cooler gases to the interface of said inner layer and said wallboard, said stud further comprising an internal gap formed between said flange inner layer and outer layer, whereby air within said internal gap that becomes heated will tend to move vertically upward, within said gap.

2. A fire-resistant wall, comprising a plurality of vertically disposed studs as defined in claim 1, wherein said studs are mounted in fixed parallel relation with boards mounted therebetween forming a hollow wall, one set of said boards having edges fixed against the inner side of the flanges on said first side of said studs, and a second set of boards being affixed to the outer side of the second side of said studs.

3. A fire-resistant stud as defined in claim 1, wherein said inner layer has an elongate raised rib projecting outward in a direction away from said outer layer whereby air that becomes heated in a gap, formed by said rib, between said inner layer and wallboard affixed against said inner side, will tend to move vertically upward within said gap.

4. A fire-resistant wall, comprising a plurality of vertically disposed studs as defined in claim 3, wherein said studs are mounted in fixed parallel relation with boards mounted therebetween forming a hollow wall, one set of said boards having edges fixed against the inner side of the flanges on said first side of said studs, and a second set of boards being affixed to the outer side of the second side of said studs.

5. A fire-resistant stud as defined in claim 1 wherein said inner layer has a plurality of spaced apart holes therethrough disposed along the extent thereof at portions thereof, which will permit gases to flow outward through said inner layer holes when wallboard is disposed against said inner layer.

6. A fire-resistant stud as defined in claim 5 further comprising an elongate raised rib disposed between said holes and said inner edge of said one flange inner layer, said rib projecting outward in a direction away from said outer layer.

7. A fire-resistant stud as defined in claim 5 wherein said holes in said inner layer are disposed with a portion extending to said outer edge of the flange.

8. A fire-resistant stud as defined in claim 7 wherein said pair of flanges includes a second flange which is an extension of said first flange outer layer and which extends to a second flange outer edge, whereat the metal is reversely folded and extends back a short distance toward said inner edge forming a short lip, said lip being folded and relatively tightly pinched entirely thereacross in a plurality of short spaced sections throughout the extent thereof, said tightly pinched sections having unpinched sections disposed therebetween, whereby openings are created at the pinched sections when wallboard is disposed against the inner side of said lip.

9. A fire-resistant stud as defined in claim 8 wherein said internal gap in said first flange and the gap in said unpinched lip sections are both about 1/64 to 1/16 inch.

10. A fire-resistant wall, comprising a plurality of vertically disposed studs as defined in claim 8, wherein said studs are mounted in fixed parallel relation with boards mounted therebetween forming a hollow wall, one set of said boards having edges fixed against the inner side of the flanges on said first side of said studs, and a second set of boards being affixed to the outer side of the second side of said studs.

* * * * *